US012146266B2

(12) United States Patent
Bischof et al.

(10) Patent No.: US 12,146,266 B2
(45) Date of Patent: Nov. 19, 2024

(54) DOCTOR DEVICE AND METHOD FOR DETERMINING THE CONTACT PRESSURE OF A DOCTOR

(71) Applicant: Voith Patent GmbH, Heidenheim (DE)

(72) Inventors: Hubert Bischof, Muerzzuschlag (AT); Welf Zimmermann, Heidenheim (DE); Thelio Cornu, Oberkochen (DE)

(73) Assignee: Voith Patent GmbH, Heidenheim (DE)

( * ) Notice: Subject to any disclaimer, the term of this patent is extended or adjusted under 35 U.S.C. 154(b) by 308 days.

(21) Appl. No.: 17/624,402

(22) PCT Filed: Jun. 24, 2020

(86) PCT No.: PCT/EP2020/067616
§ 371 (c)(1),
(2) Date: Jan. 3, 2022

(87) PCT Pub. No.: WO2021/001226
PCT Pub. Date: Jan. 7, 2021

(65) Prior Publication Data

US 2022/0356647 A1 Nov. 10, 2022

(30) Foreign Application Priority Data

Jul. 3, 2019 (DE) ..... 10 2019 117 901.7

(51) Int. Cl.
*D21G 3/00* (2006.01)

(52) U.S. Cl.
CPC ..... *D21G 3/005* (2013.01)

(58) Field of Classification Search
CPC ..... D21G 3/005; D21G 3/00; B41F 31/04; B41F 33/0009
See application file for complete search history.

(56) References Cited

FOREIGN PATENT DOCUMENTS

| | | | | |
|---|---|---|---|---|
| DE | 102008001265 | A1 | | 10/2009 |
| EP | 1259377 | A1 | | 11/2002 |
| JP | 2016140826 | A | * | 8/2016 |
| WO | 02057079 | A1 | | 7/2002 |
| WO | 2014176590 | A1 | | 10/2014 |

* cited by examiner

*Primary Examiner* — Jacob T Minskey
*Assistant Examiner* — Matthew M Eslami
(74) *Attorney, Agent, or Firm* — Laurence A. Greenberg; Werner H. Stemer; Ralph E. Locher

(57) ABSTRACT

The invention relates to a doctor device, associated with a contact surface, in particular a rotating roller. The doctor device has a doctor blade, provided for placement against the roller, for bringing the doctor blade into contact with the roller by way of a pressurized fluid. At least one sensor is provided on the doctor blade, for generating a measured value for the contact pressure of the doctor when it is placed against the roller. There is a control unit which controls the speed at which the doctor can be placed against the contact surface, in particular the roller.

13 Claims, 1 Drawing Sheet

DOCTOR DEVICE AND METHOD FOR DETERMINING THE CONTACT PRESSURE OF A DOCTOR

FIELD AND BACKGROUND OF THE INVENTION

The invention relates to a doctor device associated with a contact surface, in particular a rotating roll, the doctor device having a doctor intended to be applied to the roll to press the doctor onto the roll by means of a fluid under pressure, and having at least one sensor arranged on the doctor, with which, when the doctor is applied to the roll, a measured value for its contact pressure can be generated.

During the production of printing material webs, in particular paper webs, doctors are used at many points. These have a thin blade made of metal or plastic or a fiber composite material, which are pressed against a roll in order to clean the latter or in order to ensure that the still moist paper web is detached from the roll. The blade is a consumable material which must be replaced regularly. The prior art discloses blades mounted in a doctor holder. The doctor holder remains permanently in the machine. According to the prior art, the doctor holder is connected to a pneumatic system, by means of which the holder or the blade itself is applied to the roll as a result of the action of compressed air.

EP 1 259 377 B1 discloses a doctor device having at least one strain gauge sensor which is arranged on the doctor and with which, when the doctor is applied to the roll, its contact pressure can be measured. A multiplicity of strain gauge sensors can be distributed over the length of the doctor.

Systems and methods for measuring the loading and vibration of doctor blades and for reducing the vibration are disclosed in WO 2014/176590 A1. To measure the vibration of the doctor, a piezoelectric dynamic strain gauge is attached to a supporting element which carries the doctor.

However, such a piezoelectric strain gauge has the problem that the indicated measured value has a dynamic component in addition to a static component. The static component corresponds to the blade pressure which is to be determined, i.e. the pressure with which the blade of the doctor rests on the roll surface. The dynamic component arises from the fact that the air pressure in the pneumatic system needs a certain amount of time until it has been built up completely or, in a rotating roll, from vibrations of the rotating parts. These dynamic components are of no interest in the measurement of the blade pressure.

In practice, it has been shown that the pressure relationships are different in each system for producing a printing material web and even for each individual doctor. The air pressure for the contact pneumatics is frequently adjusted by opening or closing the appropriate valves, or the air pressure is controlled in a central switch cabinet from which, for example, there are hose connections to the doctor holders. The hose connections can have a length of up to 100 m. This means that the distance between the doctor and the pressure source depends on the installation position of the doctor. This leads to there being a different amount of time until the full contact pressure is applied to the doctor. Time intervals between 1 s and 30 s until the full contact pressure was applied were observed on paper machines.

In order to extract the dynamic component from the measured value, an individual calibration would have to be carried out for each individual doctor position. Here, the effort on calibration would be greater than the actual effort on measurement. In addition, in the event of a very slow buildup of pressure and therefore a very slow application of the doctor blade, no voltage can be built up in a piezoelectric element, which leads to failure of the measuring system.

Numerous physical variables such as pressure and acceleration can be measured by means of piezoelectric measurement technology. For pressure sensors, a thin membrane having known dimensions and a solid base is used in order to ensure that the pressure loads the components in a desired direction. In the case of accelerometers, a so-called seismic mass, i.e. a mass subjected to vibrations, is connected to piezoelectric crystal elements. When the accelerometer perceives a movement, the seismic mass loads the components in accordance with Newton's second law of motion F=m a. The disadvantage of this measurement structure consists in the fact that the sensor responds to more than one single physical variable, specifically to pressure and acceleration, the sensor not distinguishing between these two variables.

The sensor acts in principle in a similar way to a capacitor and generates an electrical voltage only when a state change occurs. If, for example, a pressure is exerted on the sensor, a voltage is generated. If the applied pressure is constant, then the sensor outputs a voltage only for a certain time. Once the voltage has been discharged, a measured variable can no longer be determined until the time at which the pressure changes again. The speed or acceleration of the pressure change has an influence on the voltage generated. It is possible to compensate for this circumstance by calibration or a complicated sensor design having a plurality of elements in different spatial planes.

SUMMARY OF THE INVENTION

The object of the invention is to arrange for the application of the doctor, i.e. the doctor blade, to the surface of the roll always to be carried out with a defined speed irrespective of the installation location of the doctor or the situation of the factory.

According to the invention, this object is achieved by the claimed invention.

The doctor device comprises in particular a doctor and feed lines for a fluid for the application of the doctor.

The invention permits measurements on different doctor devices without having to carry out an independent calibration each time for this purpose or without a sensor design comprising a plurality of components being needed. A measuring system equipped with sensors needs only to go through a single basic calibration.

There is a control unit which controls the speed with which the doctor can be applied to the contact surface, in particular the roll.

Controlling the speed with which the doctor can be applied to the contact surface can in particular be carried out by the application of the doctor by the application with the fluid under pressure being carried out in a definable or defined and also reproducible manner. In the prior art, in which hose connections between the pressure source and the doctor can have a length of up to 100 m and in which the distance between the doctor and the pressure source depends on the installation position of the doctor, this leads to there being a different time until the full contact pressure is applied to the doctor, since when compressible fluids such as air are used, there is some time until, when compressible fluids such as, for example, air, are used, the full pressure has been built up at the end of the hose connection. Time intervals between 1 s and 30 s until the full contact pressure was applied were observed on paper machines.

During the pressure buildup in the hose connection, the doctor blade already moves and the application process starts, not in a defined manner, however, but in a manner which depends highly on the situation on the system such as the hose lengths, etc.

As a result of the provision of the control unit, defined conditions are now created. The connections upstream of the control unit can be filled with fluid even before the measurement or the application process, so that at the start of the application defined pressure relationships prevail at the input to the control unit—how long this takes and with what dynamics the pressure is built up is unimportant. The control unit can then control the application process and therefore the application speed of the doctor, for example via the opening and closing of valves and the appropriate time specifications. Since the pressure of the fluid at the input to the control unit is known, just as the relationships in the control unit itself (hose lengths, valve dynamics, etc.) are also known and fixed, this procedure is also reproducible, irrespective of how far the respective doctor is from the compressed air source.

Advantageous developments emerge from the sub-claims.

Preferably, the doctor comprises a doctor blade to be applied to the roll and a doctor holder for holding the doctor blade.

As a result of using a fluid under pressure, the position of the doctor with respect to the roll is changed and, as a result, the doctor blade of the doctor is pressed against the roll.

The doctor blade does not necessarily have to be made in one piece. Advantageously, provision can also be made for the doctor blade to comprise a plurality of—separately transportable—segments, which can be connected to one another mechanically and electrically in accordance with the paper machine width before use.

Advantageously, the doctor is connected to at least one switch, by means of which the doctor can be applied to the contact surface or in particular the roll or pivoted away from the latter.

The invention also relates to a method for determining the contact pressure of a doctor.

It is a further object of the invention to calibrate a doctor once for use on a contact surface.

According to the invention, this object is achieved in that a doctor that can be pressed against a contact surface is connected to a control unit controlling the inflow of a fluid under pressure, and in that the fluid is led up to the doctor for a predefined application time, during which the pressure is increased to a desired pressure maximum.

Preferably, the application time is chosen such that it is matched to the pressure rise time used during the calibration.

It is likewise advantageous if the control unit comprises a switching means, in particular an adjustable timer relay, by means of which the desired application time is chosen.

In addition, provision is advantageously made for a throttle valve to be provided between the switch and a connector of the doctor, by means of which throttle valve the supply pressure of the fluid at the inflow to the control unit is lowered to an application pressure of the doctor.

The control unit can have one or more connectors, through which it can be supplied with fluid.

The fluid can be compressed air.

Application pressures of the fluid with which the doctor is applied to the roll can lie between 1 and 3 bar, in particular between 1.5 and 2 bar.

Supply pressures of the fluid can be at different levels. Thus, supply pressures from 8 bar-12 bar can be provided if, for example, the fluid supply is provided via the compressed air network of the factory. The supply pressures can, however, also be lower, for example around 4-5 bar. These can be achieved, amongst other things, by mobile compressed air sources.

As a result of the interposition of the throttle valve, it is possible to ensure that the application pressure is always at the same level, irrespective of the supply pressure, as long as the supply pressure is at least as high as or higher than the application pressure.

The application pressure is the pressure level with which the application of the doctor is operated, that is to say the pressure which is to be applied to the doctor holder, and not the contact pressure with which the applied doctor presses onto the roll.

Here, a measuring system determines the contact pressure of the doctor during the application process.

Preferably, the measuring system determines the contact pressure of the doctor, in particular on the surface of the roll, by predefining the time period and a pressure of the fluid during the application process. By predefining the time, it is possible to dispense with individual calibration, since the unit makes it possible to apply any desired pneumatic doctor holder of a machine for processing a printing material, in particular a paper machine, to the contact surface, in particular of a roll, during a defined time with a defined pressure of the fluid, i.e. compressed air or a hydraulic medium. The sources of error of the sensor acceleration, such as occur in the prior art, and the speed of the state change can be eliminated via a basic calibration by using the control or monitoring unit according to the invention. It goes without saying that, in addition to detecting the contact pressure, vibrations of the doctor and/or its temperature, in particular in conjunction with the contact surface to which the doctor is applied, can also be detected by the measuring device according to the invention.

Likewise, at least one piezoelectric sensor or a strain gauge is used in the measuring system.

BRIEF DESCRIPTION OF THE FIGURES

The invention will be explained in more detail below in an exemplary embodiment and with reference to the following drawings, in which.

DETAILED DESCRIPTION OF THE INVENTION

Figure 1:
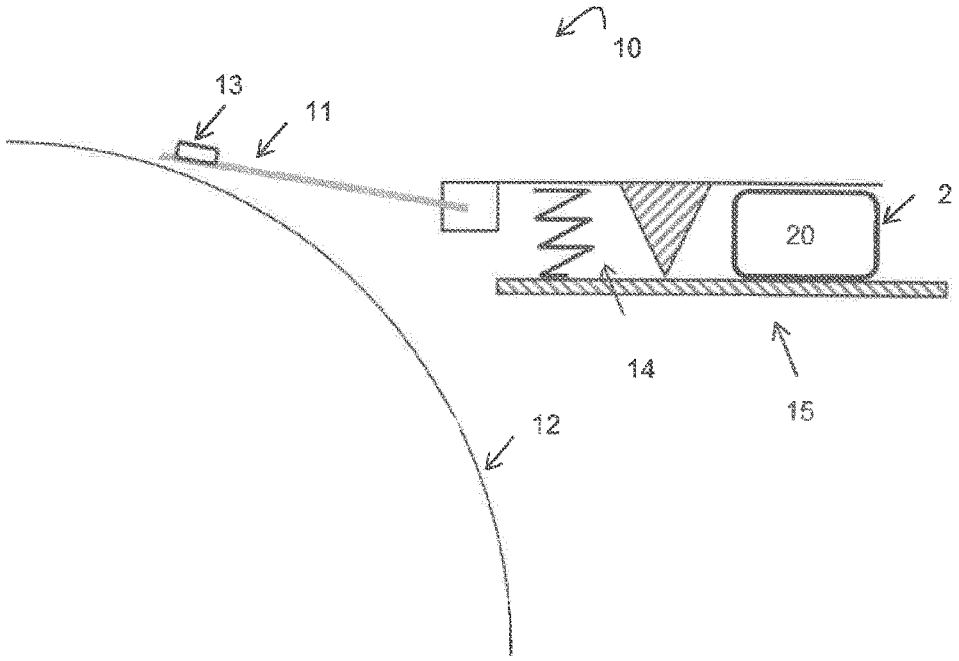
FIG. 1 shows a schematic illustration of a doctor which is fixed in a doctor holder and rests on a roll.

A doctor blade 11 can be applied to the lateral surface of a roll 12 (FIG. 1) by means of a doctor blade holder 15. Whether the hose 20 is pressurized, and with which contact pressure presses the blade 11 against the roll 12 is detected by means of a sensor 13 which, for example, is a piezoelectric sensor or a strain gauge, wherein the strain gauge can simultaneously be formed as a piezoelectric sensor.

The doctor blade 11 is mounted in a doctor holder 15 and is pressed by means of an application or pneumatic hose 20 against the lateral surface of the roll 12 or withdrawn from the latter counter to the restoring force, for example of a spring 14 or of a pneumatic hose, wherein the hose 20 is provided with a connector 2 via which the compressed air is supplied.

Figure 2:
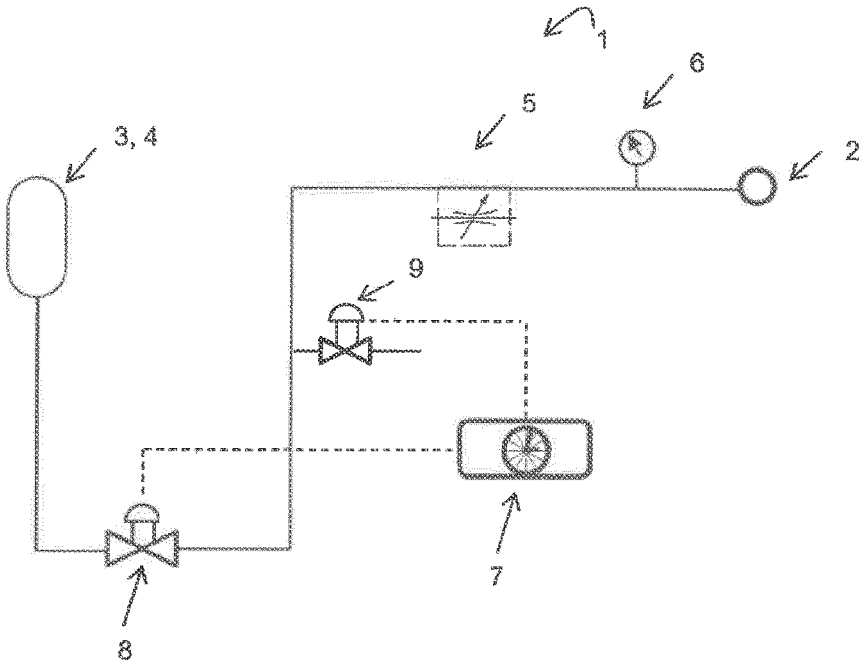
FIG. 2 shows a control unit for controlling the contact pressure of the doctor on a contact surface.

The connector 2 (FIG. 2) is connected to a pneumatic control unit 1. Via the connector 2, the application hose 20 is connected to the compressed air supply via the control unit 1. As the pressure rises, the hose 20 expands and presses the doctor blade 11 in the direction of the surface of the roll 12. The contact pressure of the blade 11 is determined by means of the sensor 13. To determine the profile of the blade 11 over the width of the roll, i.e. in the longitudinal direction of the latter, many sensors 13 are usually provided. The compressed air is provided, for example, by the compressed air supply of a paper mill and has, for example, a pressure of 8 bar or else of 12 bar.

The control unit 1 comprises a valve or a switch 8 for applying the compressed air to the connector 2 and therefore to the doctor 10, and also a valve or a switch 9 for lifting the doctor 10 off the roll 12. The compressed air designated above is applied to the switch 8. The pressure which is to be applied to the doctor holder 15 can be adjusted manually or automatically at a throttle 5. This application pressure lies considerably below the pressure level of the compressed air supply. Typical values for this application pressure lie between 1 and 3 bar, in particular between 1.5 and 2 bar. Accordingly, a connector 3 for a pressure supply at the pressure level of the factory system is provided, namely for up to 12 bar, and/or a connector 4 for a pressure of up to 4.5 bar. A manometer 6 can optionally be provided downstream of the throttle 5.

If the switch 8 is opened, the application process of the doctor blade 11 is started. The measuring operation of the sensors or of the single sensor 13 on the doctor blade 11 is also likewise started. Since the control unit 1 is connected directly to the connector 2 of the doctor 10, the application process starts virtually immediately with the actuation of the switch 8.

In addition, the control unit 1 comprises a timer relay 7 as a switch. A defined application time can be adjusted on this relay. The times for this lie, for example, in a range between 0.5 s and 20 s, preferably between 1 s and 5 s. The number of variants is preferably determined to be less than the order of magnitude of 10, since for each variant a calibration has to be carried out in advance, in order to correct the dynamic error.

The application time begins with the actuation of the switch 7. Following the expiry of a predefined time, the pressure supply to the doctor 10 is interrupted. This is done via the valve 9. Alternatively, the valve 8 could also be closed.

An outlet, with which the compressed air from the application hose 20 of the doctor 10 can be discharged, is preferably provided on the valve 9. As a result, it is possible to lift the doctor 10 or the blade 11 off the roll 12 again and, during this lifting process, to carry out a defined measurement once more. The value measured by the sensor 13 will rise from the time it is switched on until the end of the measuring time period. When the valve 9 (or else the valve 8) is closed, a display unit (not illustrated here) has a pressure peak, which then falls again slowly, as a rule over a time period of seconds. From the course of the curve from the time of switching on until the peak is reached, it is possible to draw conclusions about the real application force of the doctor 10 on the roll 12. For this step from the course of the curve to the current force value, calibrations are carried out in advance. Since only a relatively low number of measuring time periods is stored, for example a maximum of ten, and all the remaining adjustments remain the same, this is possible with little outlay.

Preferably, a very small distance is maintained between the outlet 2 of the control system 1 and the inlet to the application hose 20. In every case, the same length must be present during operation as during the calibration measurements. A length of less than 2 m, in particular of less than 1 m, is advantageous.

According to the invention, the error sources "sensor acceleration" and "speed of the state change" are eliminated via the control unit 1 by using the basic calibration. After the measuring process, the compressed air in the application hose 20 can be discharged by actuating the switch 9. During the process of lifting the doctor 10, a measurement can be carried out again by using a system based on piezoelectric sensors. If the measurement is carried out by using other sensors such as, for example, strain gauges, the measurement can also be carried out between the application process and the lifting process. Between the application and the lifting, the pressure in the hose 20 of the doctor holder 15 is maintained.

The invention can be implemented with a compressed air buffer. This applies in particular to a system for producing or processing a printing material web, in which the access to an independent compressed air system is not accessible or accessible only with difficulty. It is additionally possible for a low-frequency or high-frequency change between application and lifting in sinusoidal form to be implemented. The performance can be completed with an output signal to the measuring system, irrespective of the sensors used. The throttle 5 can be adjusted automatically. The control unit 1 can also be used independently of the sensors used, only the advantage of the adjustability of the pressure then being used. It is also possible to use measuring systems which are movement-dependent and not based on the piezoelectric principle. Therefore, the control unit 1 constitutes an electro-pneumatic control unit, which can be used as a power source for peripheral devices, for example for peripheral devices such as light beams, for example, or a measuring system for measuring the load profile of the doctor 10. Likewise, tightness measurements can also be carried out on the doctor 10.

LIST OF DESIGNATIONS

1 Pneumatic control unit
2 Doctor holder/application hose connector
3, 4 Compressed air supply connector
5 Throttle valve
6 Manometer (analog or digital)
7 Timer relay
8, 9 Switch/valve
10 Doctor
11 Doctor blade
12 Roll
13 (Piezoelectric) sensor
14 Restoring element
15 Doctor holder
20 Application hose/pneumatic hose (with connector 2)

The invention claimed is:

1. A doctor device, comprising:

a doctor to be applied to a contact surface by pressure from a fluid under pressure;

at least one sensor arranged on said doctor, said sensor being configured to generate a measured value for a contact pressure when said doctor is disposed to press against the roll;

a control unit configured to control a speed with which said doctor is applied to the contact surface; and at least one switch connected to said doctor and configured to selectively apply said doctor to the contact surface, and the contact surface being a surface on a rotating roll and said at least one switch being configured to cause the doctor to approach the contact surface of the rotating roll.

2. The doctor device according to claim 1, wherein the contact surface is a surface on a rotating roll and said doctor is configured to be applied to the contact surface of the rotating roll.

3. The doctor device according to claim 2, wherein said doctor comprises a doctor blade for pressing onto the roll and a doctor holder for holding said doctor blade.

4. The doctor device according to claim 1, wherein said at least one switch is configured to cause the doctor to pivot away from the contact surface of the rotating roll.

5. The doctor device according to claim 1, wherein said sensor comprises a piezoelectric sensor or a strain gauge.

6. A method of determining a contact pressure of a doctor, the method comprising:

connecting the doctor to a control unit that is configured to control an inflow of a fluid under pressure and a speed with which said doctor is applied to a contact surface, wherein the contact surface is a surface on a rotating roll;

providing at least one sensor on said doctor for generating a measured value for a contact pressure when the doctor is pressed against the roll;

providing at least one switch connected to said doctor for selectively applying said doctor to the contact surface;

pressing the doctor onto the contact surface under control of the control unit while controlling the inflow of the fluid under pressure and leading the fluid up to the doctor for a predefinable application time to thereby increase the pressure up to a desired pressure maximum.

7. The method according to claim 6, which comprises choosing the application time to match a pressure rise time used during a calibration.

8. The method according to claim 6, wherein the control unit comprises a switching means configured to choose the desired application time.

9. The method according to claim 8, wherein the switching means is a timer relay.

10. The method according to claim 6, which comprises providing a throttle valve between the switch and a connector of the doctor, and lowering a supply pressure of the fluid at an inflow to the control unit by way of the throttle valve to an application pressure of the doctor.

11. The method according to claim 6, which comprises using a measuring system to determine the contact pressure of the doctor during an application process.

12. The method according to claim 11, which comprises using the measuring system to determine the contact pressure of the doctor by predefining a time period and a pressure of the fluid during the application process.

13. The method according to claim 11, wherein the measuring system uses at least one piezoelectric sensor or a strain gauge.

* * * * *